US009527639B2

(12) United States Patent
Walton

(10) Patent No.: US 9,527,639 B2
(45) Date of Patent: Dec. 27, 2016

(54) DIP TUBE INSERTION MEMBER FOR FACILITATING INSERTION OF A DIP TUBE INTO A CONTAINER WITHOUT REMOVING THE CONTAINER CAP

(71) Applicant: Cardomon International Limited, Tsimshatsui, Kowlon (HK)

(72) Inventor: Philip A. Walton, Bishop Auckland (GB)

(73) Assignee: Cardomon International Limited, Hong Kong (HK)

( * ) Notice: Subject to any disclaimer, the term of this patent is extended or adjusted under 35 U.S.C. 154(b) by 0 days.

(21) Appl. No.: 14/604,904

(22) Filed: Jan. 26, 2015

(65) Prior Publication Data

US 2016/0214771 A1 Jul. 28, 2016

(51) Int. Cl.
*B67D 1/00* (2006.01)
*B65D 51/22* (2006.01)
(Continued)

(52) U.S. Cl.
CPC ..... *B65D 51/222* (2013.01); *B05B 15/005* (2013.01); *B65D 47/06* (2013.01); *B67B 7/26* (2013.01);
(Continued)

(58) Field of Classification Search
CPC ..... B65D 47/06; B65D 51/222; B05B 15/005; B67B 7/26; B67D 1/0004; B67D 1/08; B67D 1/02; B67D 1/0829
(Continued)

(56) References Cited

U.S. PATENT DOCUMENTS 4,058,121 A * 11/1977 Choksi ..... A61J 1/2096 604/274
4,265,372 A 5/1981 Wainberg
(Continued)

FOREIGN PATENT DOCUMENTS

DE 390369 2/1924
DE 1293052 4/1969
(Continued)

OTHER PUBLICATIONS

International Search Report and Written Opinion dated Mar. 24, 2016 issued in International Application No. PCT/IB2015/060077 (which claims priority from the subject patent application), 13 pages.

(Continued)

*Primary Examiner* — Lien Ngo
(74) *Attorney, Agent, or Firm* — Merek, Blackmon & Voorhees, LLC

(57) ABSTRACT

A dip tube insertion member adapted to be used with a liquid dispensing apparatus. The dip tube insertion member facilitates insertion of a dip tube into a liquid storage container without removing the sealing cap of a liquid storage container. The dip tube insertion member includes a probe having a hollow cavity for receiving a dip tube. The probe further includes an upper opening and a lower opening for facilitating insertion of a dip tube into the liquid container. Preferably, the dip tube insertion member takes the form of a cap that is mounted on and about at least a portion of the sealing cap of a liquid storage container of the liquid dispensing apparatus. The dip tube insertion member preferably includes a sealing member forming an air chamber surrounding the probe.

20 Claims, 10 Drawing Sheets

(51) Int. Cl.

| | |
|---|---|
| ***B05B 15/00*** | (2006.01) |
| ***B65D 47/06*** | (2006.01) |
| ***B67B 7/00*** | (2006.01) |
| ***B67D 1/08*** | (2006.01) |

(52) U.S. Cl.
CPC ..... *B67D 1/0004* (2013.01); *B67D 1/0802* (2013.01); *B67D 1/0829* (2013.01)

(58) Field of Classification Search
USPC ..... 222/80–83, 83.5, 181.1, 464.3
See application file for complete search history.

(56) References Cited

U.S. PATENT DOCUMENTS

| | | | | |
|---|---|---|---|---|
| 4,484,697 | A | 11/1984 | Fry | |
| 4,997,429 | A * | 3/1991 | Dickerhoff | A61J 1/1412 604/405 |
| 5,392,968 | A * | 2/1995 | Dark | B65D 47/066 222/528 |
| 5,553,748 | A | 9/1996 | Battle | |
| 5,975,359 | A | 11/1999 | Van Marcke | |
| 6,139,534 | A * | 10/2000 | Niedospial, Jr. | A61J 1/2096 604/403 |
| 6,161,728 | A * | 12/2000 | Dark | B65D 47/36 222/153.07 |
| 6,269,976 | B1 * | 8/2001 | DeJonge | B05B 11/3047 222/321.7 |
| 6,832,994 | B2 * | 12/2004 | Niedospial, Jr. | A61J 1/2096 604/403 |
| 7,168,599 | B1 | 1/2007 | Criswell | |
| 8,672,155 | B2 * | 3/2014 | Knierbein | 215/228 |
| 8,887,955 | B2 | 11/2014 | Walton | |
| 9,101,936 | B2 | 8/2015 | Marcher et al. | |
| 2005/0121464 | A1 | 6/2005 | Miller | |
| 2006/0032864 | A1 | 2/2006 | Jung | |
| 2007/0032775 | A1 | 2/2007 | Niedospial et al. | |
| 2013/0048681 | A1 | 2/2013 | Walton | |
| 2013/0053815 | A1 * | 2/2013 | Mucientes | A61J 1/1406 604/414 |
| 2015/0284235 | A1 | 10/2015 | Blackburn | |

FOREIGN PATENT DOCUMENTS

| | | |
|---|---|---|
| EP | 0141433 | 5/1985 |
| EP | 2017195 | 1/2009 |
| GB | 2046226 | 11/1980 |
| WO | WO 87/05208 | 9/1987 |
| WO | WO92/19528 | 11/1992 |
| WO | WO2007/081208 | 7/2007 |

OTHER PUBLICATIONS

International Search Report and Written Opinion, Jun. 30, 2016 issued in International Application No. PCT/IB2016/052481, 13 pages.

Office Action dated Aug. 19, 2016 issued in U.S. Appl. No. 14/714,456, filed May 18, 2015, 13 pages.

* cited by examiner

DIP TUBE INSERTION MEMBER FOR FACILITATING INSERTION OF A DIP TUBE INTO A CONTAINER WITHOUT REMOVING THE CONTAINER CAP

FIELD OF THE INVENTION

The present invention is directed to a dispensing apparatus for dispensing liquid from a liquid storage container and a dip tube insertion member for facilitating insertion of a dip tube into the liquid storage container without removing the sealing cap of the liquid storage container. The dispensing apparatus may dispense any suitable liquid including but not limited to chilled drinking water, hot water, ambient temperature drinking water, carbonated liquid and/or any combination thereof. The liquid storage container may include but is not limited to a replaceable five (5) gallon water bottle stored in a lower portion of the dispensing apparatus. The liquid storage container may include a one-piece sealing cap or a multi-piece sealing cap (e.g. a two-piece sealing cap). In its most preferred form, the present invention is directed to a device for use with liquid dispensing units dispensing at least chilled drinking water from a replaceable five (5) gallon water bottle stored in a lower portion of the dispensing unit in an upright orientation.

BACKGROUND OF THE INVENTION

A significant number of existing water dispensers use gravity as the driving force to dispense water from the water dispenser. In this type of water dispenser, the water bottle is positioned above the dispensing location. These dispensers are referred to as "Top-Loading" water dispensers. Top-Loading water dispensers typically include means for receiving a five (5) gallon water bottle at the uppermost portion of the water dispenser. Five (5) gallon water bottles are quite heavy making it difficult for some individuals to mount the water bottle on the uppermost portion of the water cooler.

To overcome the problems of Top-Loading water dispensers, water dispensers in which the water bottle is stored in the lower portion of the water dispenser have been proposed. Since these systems cannot rely upon gravity to dispense drinking water, pumps are typically employed to pump the drinking water to the dispensing location located above the water bottle. These types of water dispensers are referred to herein as "Bottom-Loading" water dispensers. An example of such a water dispenser is disclosed in U.S. Pat. No. 8,887,955 the entire contents of which are incorporated herein by reference. Bottom-Loading water dispensers address the water bottle installation problems associated with Top-Loading water dispensers. However, Bottom-Loading water dispensers employ significantly more water contact components than Top-Loading water dispensers and, therefore, are more difficult to sanitize effectively. U.S. Pat. No. 8,887,955 provides a liquid dispenser that significantly improves the sanitary characteristics of previously known liquid dispensers. The preferred form of the present invention is designed to further improve the sanitary characteristics of previously known liquid dispensers.

OBJECTS AND SUMMARY OF THE INVENTION

An object of the present invention is to provide a novel and unobvious apparatus for dispensing liquid from a liquid storage container.

Another object of the present invention is to provide a novel and unobvious dip tube insertion member that facilitates insertion of a tip tube into a liquid storage container having a sealing cap without removal of the sealing cap from the liquid storage container.

Another object of a preferred embodiment of the present invention is to provide a Bottom-Loading water dispenser that is relatively inexpensive to produce and is also easy to sanitize in a very short period of time.

Still another object of a preferred embodiment of the present invention is to provide a dip tube insertion cap that can be readily and easily mounted on and about a sealed cap of a liquid storage container.

A further object of a preferred embodiment of the present invention is to provide a dip tube insertion cap that can readily and easily unseal the sealing member of the sealing cap of a liquid storage container as the dip tube insertion cap is mounted on and about the sealing cap of the liquid storage container.

Yet another object of a preferred embodiment of the present invention is to provide a dip tube insertion member forming an air chamber that surrounds a probe where the probe receives the dip tube and unseals the sealing member of the sealing cap of the liquid storage container.

Still a further object of a preferred embodiment of the present invention is to provide a dip tube insertion member having a probe receiving the dip tube where the probe includes one or more vertically extending grooves formed in an outer surface of the probe to facilitate air entering the liquid storage container.

Yet still another object of a preferred embodiment of the present invention is to provide a dip tube insertion member having a sealing member that engages an outer peripheral surface of the sealing cap of a liquid storage container.

It must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

In summary, one preferred embodiment of the present invention is directed to a dip tube insertion member for facilitating insertion of a dip tube into a liquid container having a sealing cap without removing the sealing cap from the liquid container. The dip tube insertion member includes a probe having a hollow cavity for receiving a dip tube. The probe further includes an upper opening and a lower opening for facilitating insertion of a dip tube into the liquid container. The dip tube insertion member includes a sealing member for forming an air chamber surrounding the probe. The air chamber is configured to receive and direct air to at least one air passageway communicating with an interior of the liquid container.

Another preferred embodiment of the present invention is directed to a dip tube insertion member for facilitating insertion of a dip tube into a liquid container having a sealing cap without removing the sealing cap from the liquid container. The dip tube insertion member includes a dip tube insertion cap having at least one upper wall, at least one outer wall and a probe. The probe includes a hollow cavity for receiving a dip tube. The probe further includes an upper opening and a lower opening for facilitating insertion of a dip tube into the liquid container. The probe is configured to unseal a sealing member of the sealing cap of the liquid container to permit insertion of the dip tube into the liquid container. The at least one outer wall of the dip tube insertion cap forms an inner receiving area for receiving at least a portion of the sealing cap of the liquid container such that when the dip tube insertion member is installed on the liquid container having the sealing cap a section of the sealing cap of the liquid container extends into the receiving area and a portion of the dip tube insertion cap surrounds and covers at least a portion of the sealing cap of the liquid container.

A further preferred embodiment of the present invention is directed to an apparatus for dispensing a liquid from a liquid storage container operably associated with the apparatus for dispensing a liquid. The apparatus includes a main housing having a dispensing location at which liquid from a liquid storage container is dispensed and a storage location for storing the liquid storage container. The dispensing location is disposed above at least a portion of the storage location. The apparatus further includes a dip tube and at least one conduit. The at least one conduit connects the dip tube to the dispensing location. The apparatus further includes a dip tube insertion cap having at least one upper wall, at least one outer wall and a probe. The probe includes a hollow cavity for receiving the dip tube. The probe further includes an upper opening and a lower opening for facilitating insertion of the dip tube into the liquid storage container. The probe is configured to unseal a sealing member of the sealing cap of the liquid storage container to permit insertion of the dip tube into the liquid storage container without removing the sealing cap from the liquid storage container. The at least one outer wall of the dip tube insertion cap forms an inner receiving area for receiving at least a portion of the sealing cap of the liquid storage container such that when the dip tube insertion cap is installed on the liquid storage container having the sealing cap a section of the sealing cap of the liquid storage container extends into the receiving area and a portion of the dip tube insertion cap surrounds and covers at least a portion of the sealing cap of the liquid storage container.

DETAILED DESCRIPTION OF THE PREFERRED EMBODIMENTS OF THE INVENTION

The preferred forms of the invention will now be described with reference to FIGS. 1-15. The appended claims are not limited to the preferred forms and no term and/or phrase used herein is to be given a meaning other than its ordinary meaning unless it is expressly stated otherwise.

FIGS. 1 Through 12

Referring to FIGS. 1 to 4 and 7 to 12, a preferred form of dip tube insertion member A is illustrated in one of many possible configurations. In the most preferred form, dip tube insertion member A has a cap type structure that is mounted on and surrounds a sealing cap B sealing liquid storage container C. The dip tube insertion member A is not limited to a cap type structure but rather can take any suitable form.

Figure 3:
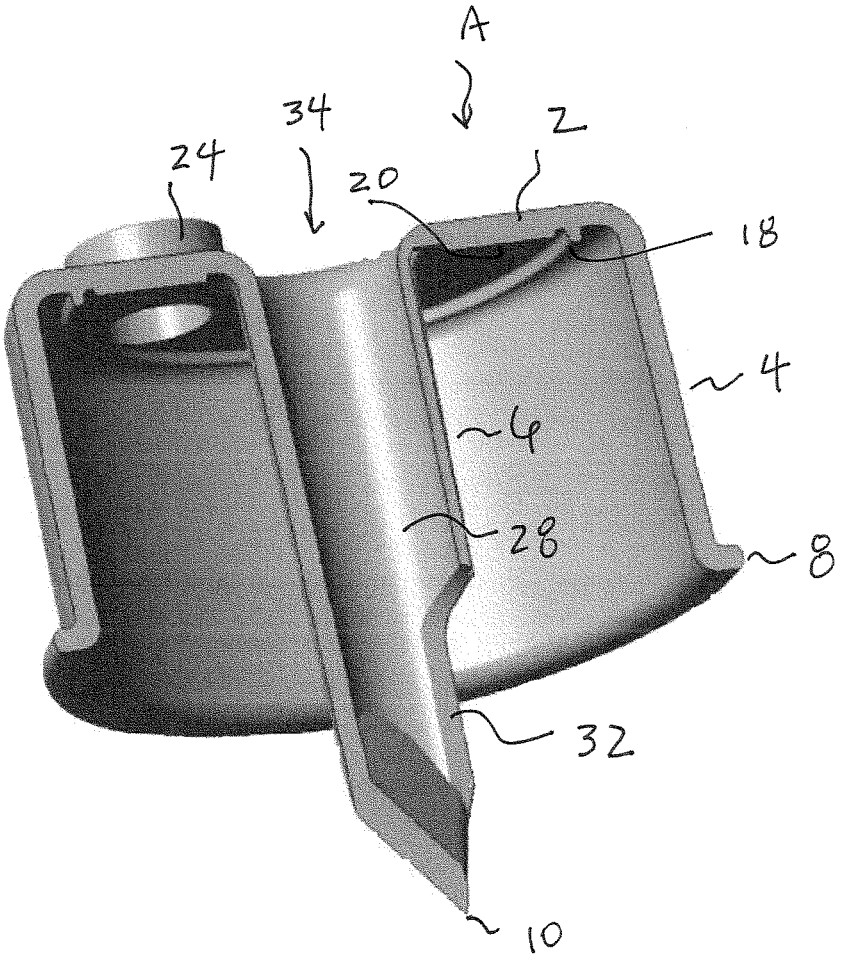
FIG. 3 is a fragmentary perspective view of the dip tube insertion member depicted in FIG. 2.
Figure 4:
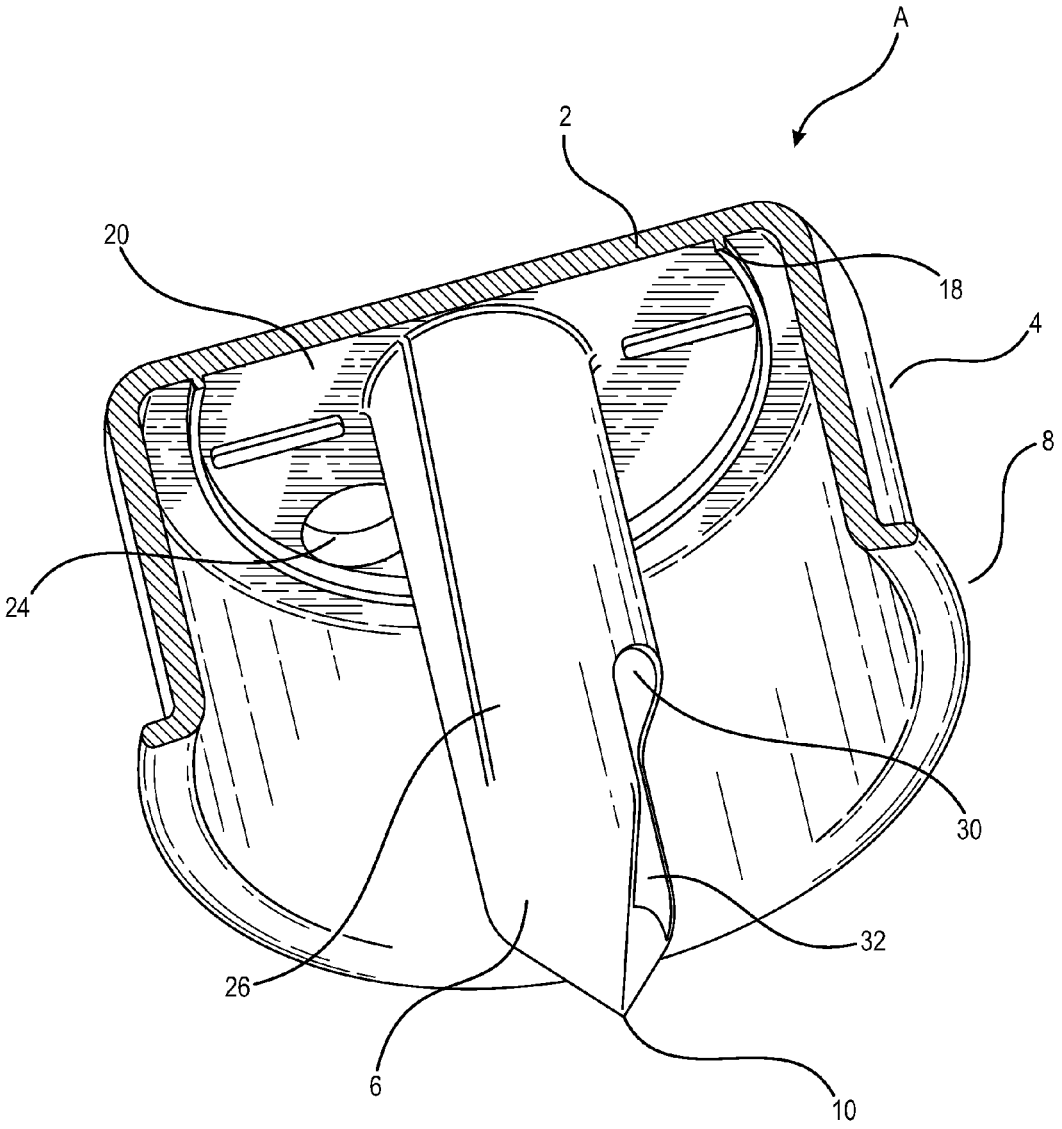
FIG. 4 is another fragmentary perspective view of the dip tube insertion member depicted in FIG. 2.
Figure 5:
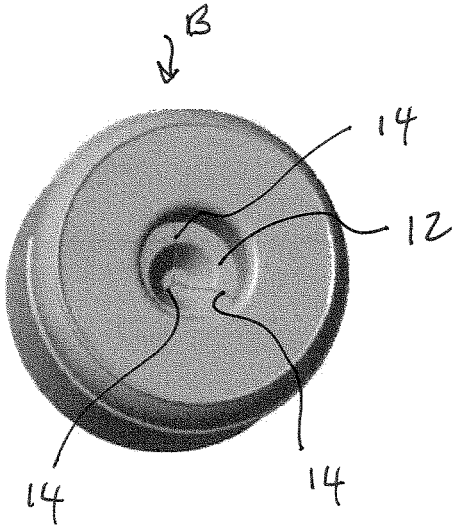
FIG. 5 is a perspective view of a one-piece sealing cap of a liquid storage container.
Figure 6:
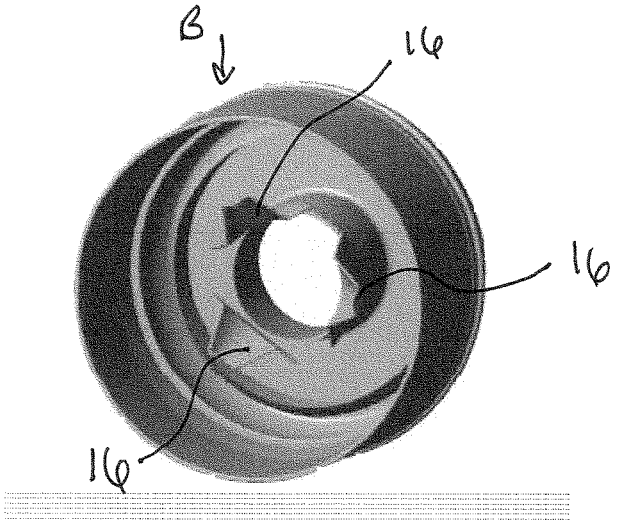
FIG. 6 is a perspective view of the bottom of the one-piece sealing cap of a liquid storage container depicted in FIG. 5 with the sealing member of the one-piece sealing cap unsealed.
Figure 7:
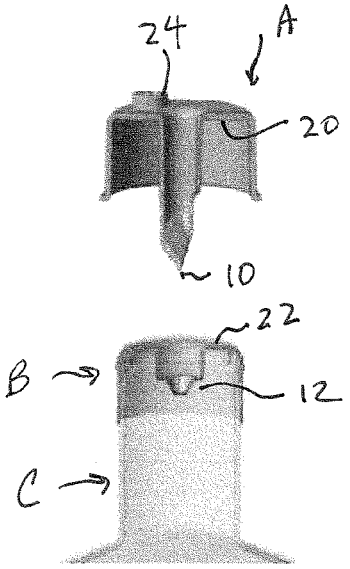
FIG. 7 is a fragmentary perspective view of the dip tube insertion member positioned above a liquid storage container having a sealing cap mounted on the liquid storage container.
Figure 8:
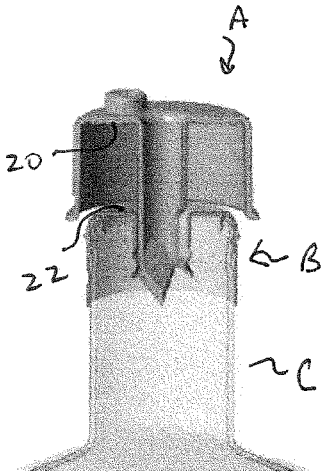
FIG. 8 is a fragmentary perspective view of the dip tube insertion member with the probe of the dip tube insertion member tearing the sealing member of the sealing cap of the liquid storage container.
Figure 9:
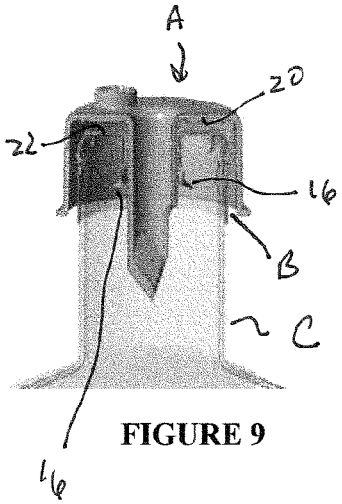
FIG. 9 is a fragmentary perspective view of the dip tube insertion member just above the final seated position on and around the sealing cap of the liquid storage container.

Referring to FIGS. 1 to 4 and 7 to 12, the dip tube insertion member A includes an upper wall 2, an outer annular wall 4 and a probe 6. The bottom of outer annular wall 4 includes an annular seating lip 8 that an individual can use to firmly seat dip tube insertion member A on sealing cap B. Preferably, probe 6 has relatively sharp tip 10 at the lowermost end of the probe. Tipped end 10 allows probe 6 to readily unseal a conventional one-piece sealing cap B. Referring to FIGS. 5 and 6, one-piece sealing cap B has a center sealing member 12 having three radially extending thinned grooves 14. Tip 10 is preferably configured to impact the inner juncture of the three radially extending thinned grooves 14.

Referring to FIGS. 7 to 10, as the probe 6 moves downwardly into the liquid storage container C, the sealing member 12 tears or breaks at the three thinned grooves 14 forming three flaps 16 that are folded back by the downward force of probe 6. FIG. 6 illustrates the one-piece sealing cap B after the probe 6 has broken the seal of the sealing cap B.

Figure 10:
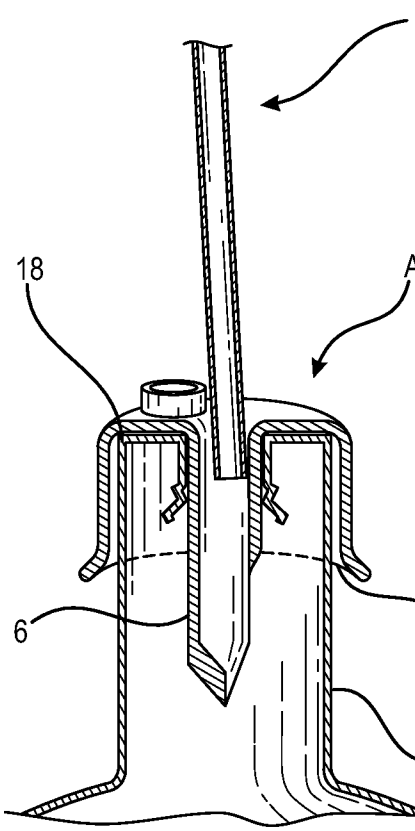
FIG. 10 is a perspective view of the dip tube insertion member in the final seated position on and around the sealing cap of the liquid storage container and a dip tube partially inserted into the hollow cavity of the probe of the dip tube insertion member.
Figure 11:
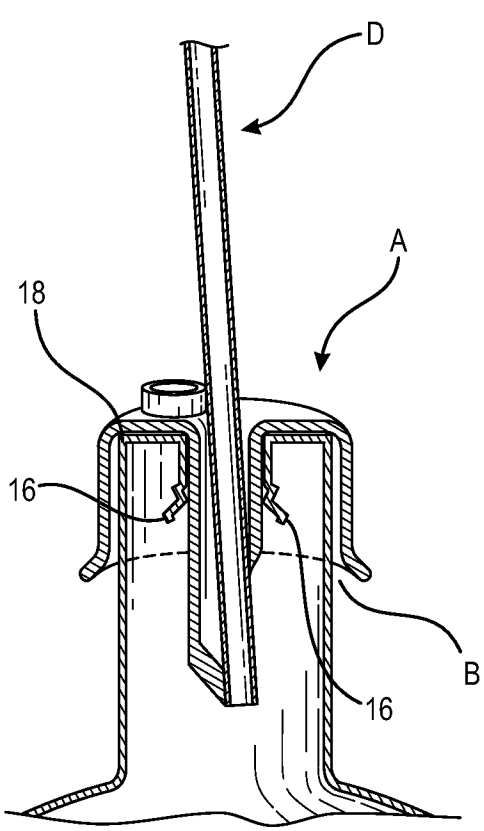
FIG. 11 is a perspective view similar to FIG. 10 with the dip tube advanced further into the liquid storage position.
Figure 12:
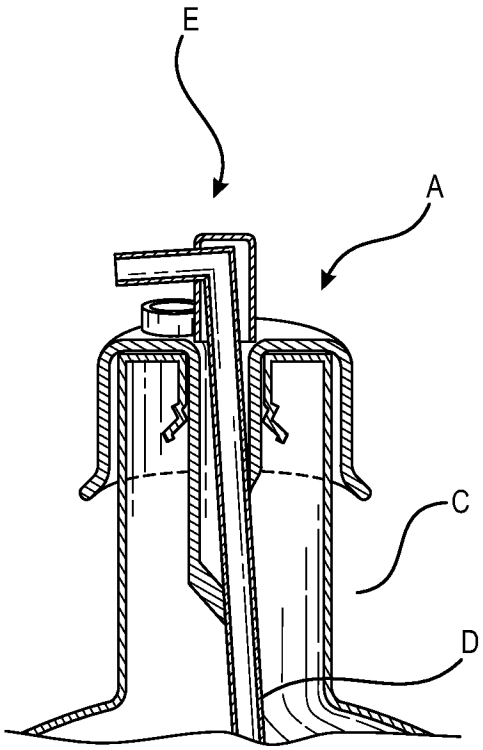
FIG. 12 is a fragmentary perspective view similar to FIG. 11 with the dip tube and conduit connector in the operating position.

Referring to FIGS. 10 to 12, dip tube insertion member A is seated on and covers sealing cap B. Preferably, annular outer wall 4 of dip tube insertion member A completely surrounds the annular outer wall of sealing cap B.

Referring to FIGS. 3, 4 and 10 to 12, dip tube insertion member A includes an annular sealing member 18 that extends downwardly from the inner surface of upper wall 2. The annular sealing member 18 completely surrounds probe 6 and engages an upper, outer peripheral surface of sealing cap B. Sealing member 18 forms an air chamber between the inner surface 20 of upper wall 2 and the upper exterior surface 22 of sealing cap B. The air chamber extends inwardly from sealing member 18 and completely surrounds probe 6.

Figure 2:
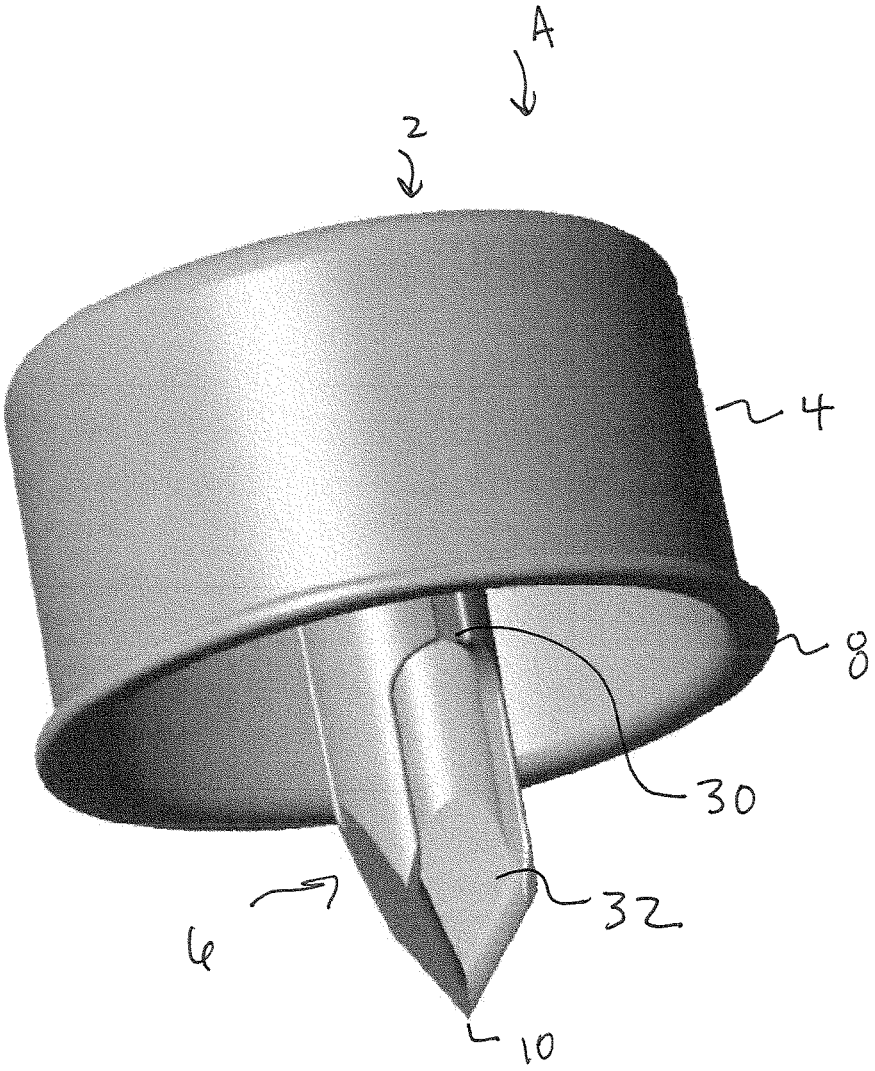
FIG. 2 is a perspective view of a dip tube insertion member formed in accordance with a preferred embodiment of the present invention.

Dip tube insertion member A includes a raised port 24. Port 24 directs air for the surrounding environment into the air chamber defined by sealing member 18. Probe 6 includes one or more vertically extending grooves or recesses formed in the outer surface of probe 6 that communicate with the air chamber and direct air into the liquid storage container C. Referring to FIGS. 3 and 4, vertically extending groove 26 has a depth less than the wall thickness of probe 6 so that groove 26 does not communicate with hollow cavity 28 formed by probe 6. Vertically extending groove 26 directs air from the air chamber downwardly along the outer surface of probe 6 into the liquid storage container C. Referring to FIG. 2, vertically extending groove 30 has a depth less than the wall thickness of probe 6 so that groove 30 does not communicate with hollow cavity 28 formed by probe 6. Vertically extending groove 30 has a length less than groove 26 as it terminates at slotted opening 32 formed in the lower portion of probe 6. However, vertically extending groove 30 still directs air from the air chamber downwardly along the outer surface of probe 6 into the liquid storage container C. While only two vertically extending grooves have been shown, probe 6 may have three or more vertically extending grooves. For example, probe 6 could have four vertically extending grooves with each groove spaced at ninety degrees in the circumferential direction from an adjacent groove.

Referring to FIGS. 3 and 10 to 12, dip tube D is inserted into opening 34 in upper wall 2 and downwardly through hollow cavity 28 and slotted opening 32 so that the lower end of dip tube D is located at the bottom or adjacent the bottom of liquid storage container C. As is readily evident from FIGS. 10 to 12, dip tube D extends in a diagonal pathway, i.e., dip tube D extends at an acute angle from a vertically extending axis passing through the center of probe 6.

Figure 1:
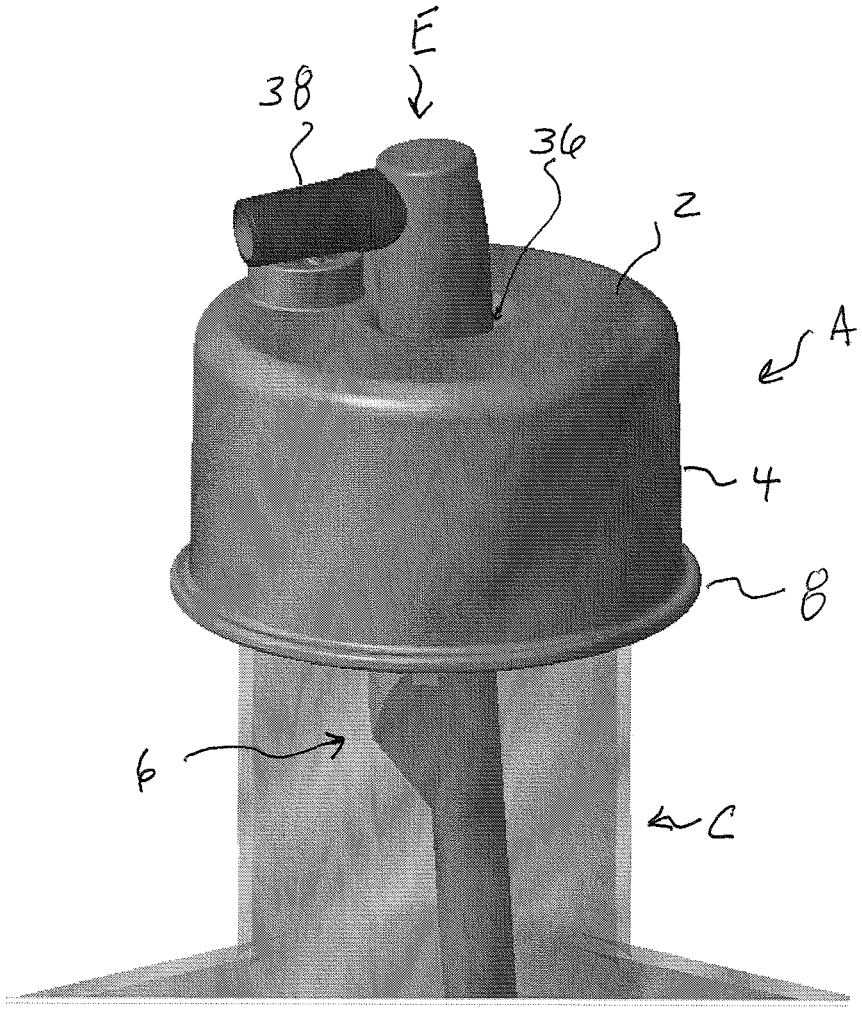
FIG. 1 is a perspective view of a dip tube insertion member formed in accordance with a preferred embodiment of the present invention where the dip tube insertion member is mounted on the sealing cap of a liquid storage container and the dip tube is inserted into the liquid storage container (only a portion of which is shown) through the dip tube insertion member. A conduit connector is mounted on the upper portion of the dip tube to seal the upper opening in the dip tube insertion member around the dip tube.

Referring to FIG. 1, a conduit connector E is seated on the upper portion of dip tube D. Base 36 of conduit connector E is preferably formed to seal the annular space between dip tube D and the surface of upper wall 2 forming opening 34. Air from the surrounding environment can only enter the liquid storage container C by passing through port 24 into the air chamber and vertically downward in the grooves formed in the outer surface of probe 6. The upper end of port 24 includes a grid having a plurality of openings permitting passage of air. The grid can be formed by two or more intersecting members or ribs. For example, four openings could be formed by two ribs oriented in a cross-type manner, i.e., perpendicular to each other. The grid provides a support surface for mounting an air filter. Hence, any air entering the liquid storage container must pass through an air filter mounted on the grid. The air filter may be secured to the grid in any suitable manner. Alternatively, the grid may be recessed inwardly from the top of port 24 a distance equal to or greater than the thickness of the air filter such that the air filter seats entirely within the upper portion of the hollow bore of port 24.

Figure 15:
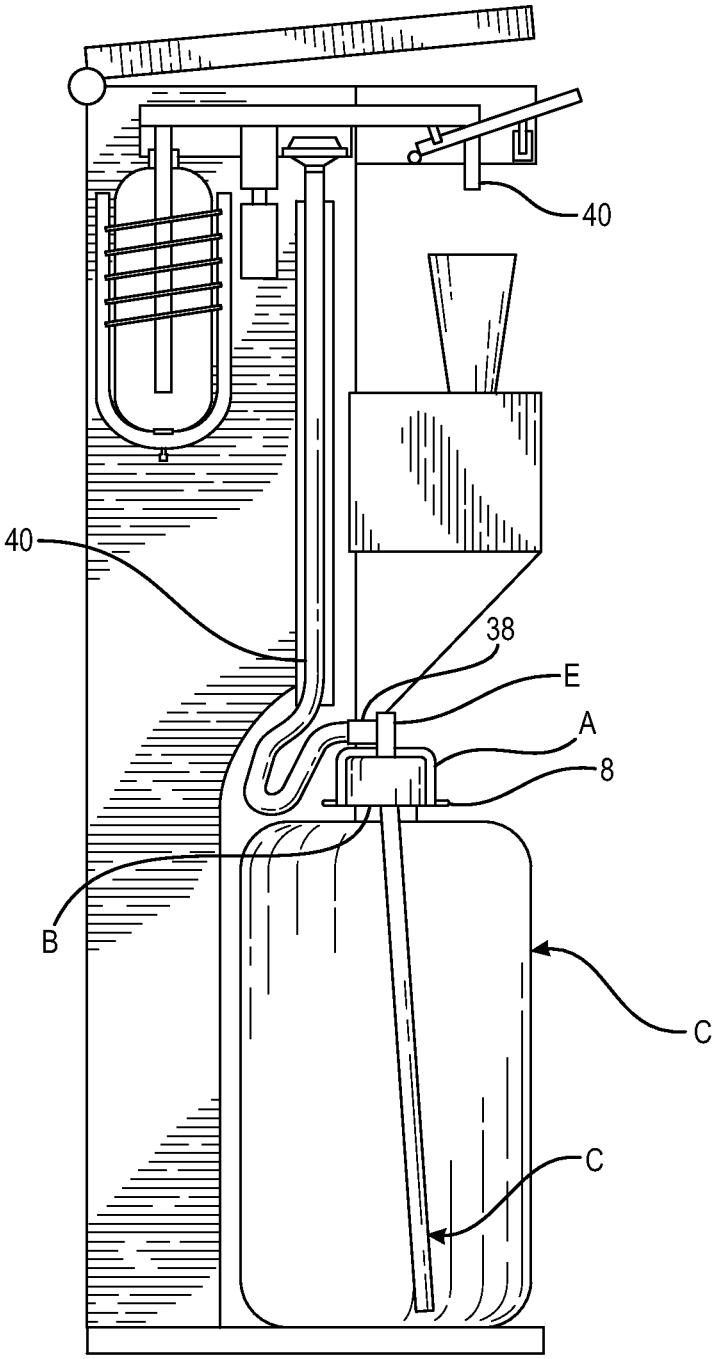
FIG. 15 is a preferred form of liquid dispensing apparatus.

Referring to FIG. 15, end 38 of conduit connector E is connected to tubing 40. Preferably, liquid from the liquid storage container C is pump from storage container C and dispensed through dispensing nozzle 40 in the manner described in U.S. Pat. No. 8,887,955. However, it is to be noted that the present invention is not limited to use with the dispensing apparatus disclosed in U.S. Pat. No. 8,887,955. Rather, the present invention can be used with any suitable dispensing apparatus.

Figure 13:
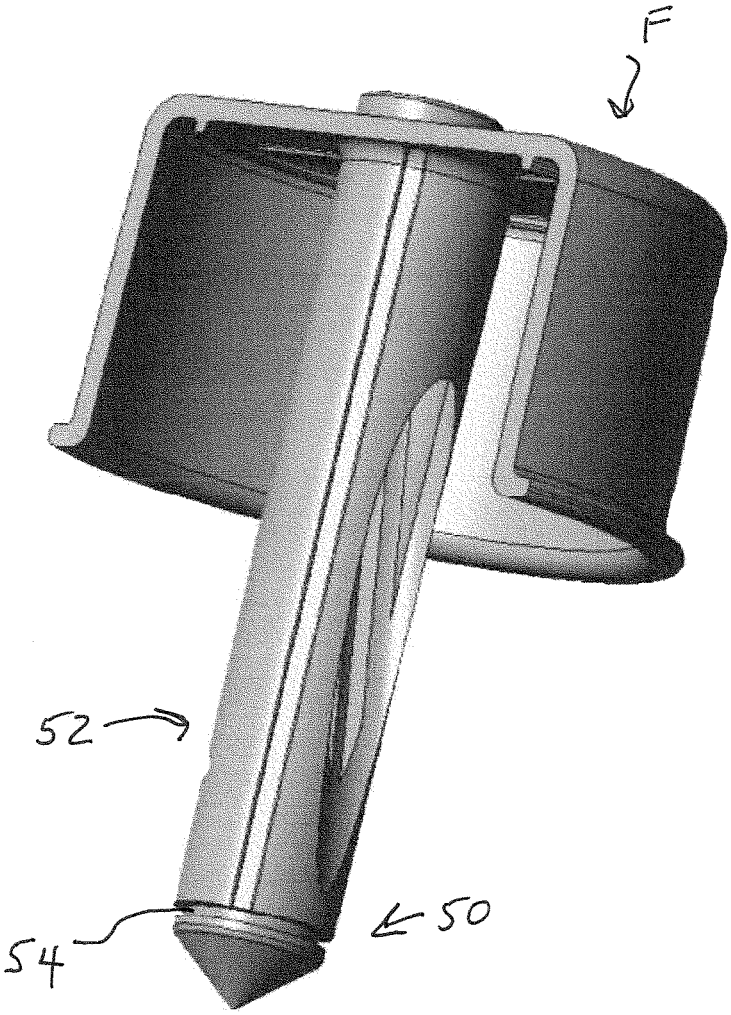
FIG. 13 is a fragmentary perspective view of a dip tube insertion member formed in accordance with another preferred embodiment of the present invention.
Figure 14:
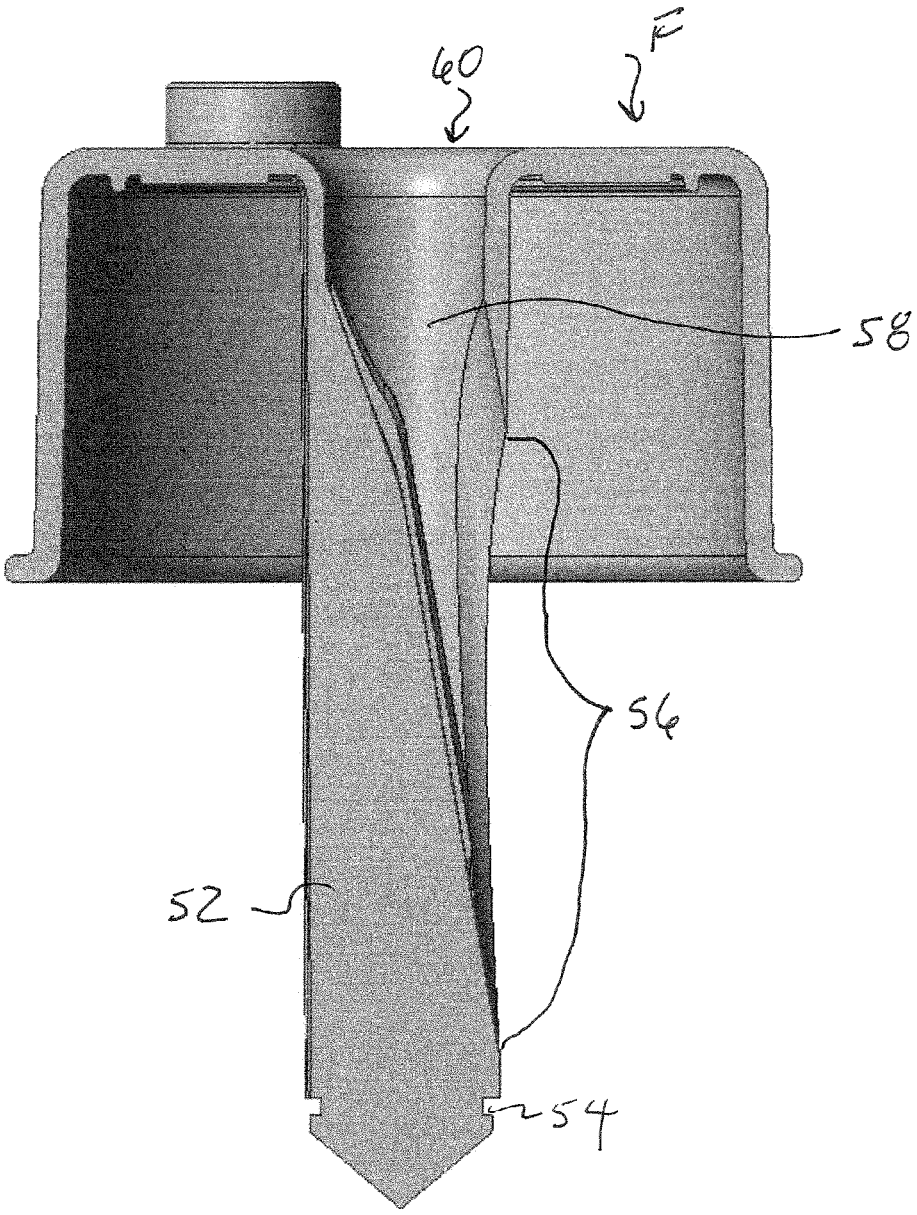
FIG. 14 is a fragmentary perspective view of the dip tube insertion member depicted in FIG. 13.

FIGS. 13 and 14

Referring to FIGS. 13 and 14, an alternative dip tube insertion member F is illustrated in one of many possible configurations. Dip tube insertion member F is similar to dip tube insertion member A and, therefore, only the differences will be described. End 50 of probe 52 of dip tube insertion member F is formed to dislodge and retain the inner cap of a two-piece sealing cap of the type described in U.S. Pat. No. 5,542,555 the entire contents of which are incorporated herein by reference. Specifically, as dip tube insertion cap F is lowered onto a two-piece sealing cap of the type described in U.S. Pat. No. 5,542,555, probe 52 engages and dislodges the inner cap (referred to in U.S. Pat. No. 5,542,555 by reference numeral 16) and the bead (referred to in U.S. Pat. No. 5,542,555 by reference numeral 42) of the inner cap nests in annular groove 54 of probe 52 to ensure that the inner cap is retained by and remains connected to probe 52. Referring to FIG. 14, slotted opening 56 formed in one side of probe 52, hollow cavity 58 and opening 60 permit insertion of the dip tube into the liquid storage container.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiment and have been written to preclude such a narrow construction using the principles of claim differentiation.

I claim:

1. A dip tube insertion member for facilitating insertion of a dip tube into a liquid container having a sealing cap without removing the sealing cap from the liquid container, said dip tube insertion member comprising:

(a) a probe having a hollow cavity for receiving a dip tube, the probe further including an upper opening and a lower opening for facilitating insertion of a dip tube into the liquid container;

(b) a sealing member for forming an air chamber surrounding the probe, the air chamber being configured to receive and direct air to at least one air passageway communicating with an interior of the liquid container; and, (c) a cap having an upper horizontally extending wall including an inner surface and an outer surface, the cap being configured such that when the dip tube insertion member is installed an uppermost surface of the liquid storage container sealing cap forms a bottom of said air chamber.

2. The dip tube insertion member of claim 1, wherein:

(a) the cap of the dip tube insertion member includes a port for receiving air, the port having an uppermost surface disposed above an uppermost surface of said probe.

3. The dip tube insertion member of claim 2, wherein:
(a) the sealing member is substantially annular and extends downwardly from the inner surface of the upper horizontally extending wall.

4. The dip tube insertion member of claim 3, wherein:
(a) the probe includes at least one wall having a first thickness, the at least one air passageway includes at least one groove having a first depth formed in an outer surface of the at least one wall of the probe, the first depth is less than the first thickness.

5. The dip tube insertion member of claim 4, wherein:
(a) the at least one air passageway includes a plurality of grooves each having a first depth, each of the plurality of grooves are formed in the outer surface of the at least one wall of the probe.

6. The dip tube insertion member of claim 5, wherein:
(a) at least one of the plurality of grooves extends substantially vertically.

7. The dip tube insertion member of claim 2, wherein:
(a) the uppermost surface of the port forms an uppermost portion of the cap of the dip tube insertion member and the port communicates with the air chamber and directs air into the air chamber.

8. The dip tube insertion member of claim 2, wherein:
(a) the sealing member is an annular ring having a lowermost end, the lowermost end of the annular ring engages the uppermost surface of the liquid storage container sealing cap when the dip tube insertion member is installed.

9. A dip tube insertion member for facilitating insertion of a dip tube into a liquid container having a sealing cap without removing the sealing cap from the liquid container, said dip tube insertion member comprising:
(a) a dip tube insertion cap having an upper horizontally extending wall, an outer wall extending downwardly from and directly contacting the upper horizontally extending wall and a probe, the probe having a hollow cavity for receiving a dip tube, the probe further including an upper opening and a lower opening for facilitating insertion of a dip tube into the liquid container, the probe being configured to unseal a sealing member of the sealing cap of the liquid container to permit insertion of the dip tube into the liquid container and the upper opening of said probe is substantially aligned with the upper horizontally extending wall; and,
(b) the outer wall of the dip tube insertion cap forms an inner receiving area for receiving at least a portion of the sealing cap of the liquid container such that when the dip tube insertion member is installed on the liquid container having the sealing cap a section of the sealing cap of the liquid container extends into the receiving area and a portion of the dip tube insertion cap surrounds and covers at least a portion of the sealing cap of the liquid container.

10. The dip tube insertion member of claim 9, further including:
(a) a sealing member for forming an air chamber surrounding an outer surface of the probe, the air chamber being configured to receive and direct air to at least one air passageway communicating with an interior of the liquid container.

11. The dip tube insertion member of claim 10, wherein:
(a) the air chamber extends from an uppermost surface of the sealing cap of the liquid container to an inner surface of the upper horizontally extending wall of the dip tube insertion cap.

12. The dip tube insertion member of claim 9, wherein:
(a) the probe includes at least one wall having a first thickness, the at least one air passageway includes at least one groove having a first depth formed in an outer surface of the at least one wall of the probe, the first depth is less than the first thickness of the at least one wall of the probe.

13. The dip tube insertion member of claim 9, wherein:
(a) the probe is disposed on a central axis of the dip tube insertion cap.

14. The dip tube insertion member of claim 9, wherein:
(a) the probe includes an unsealing portion for unsealing the sealing member of the sealing cap of the liquid container.

15. The dip tube insertion member of claim 9, wherein:
(a) the probe includes a pointed tip at a lowermost end of the probe for unsealing the sealing member of the sealing cap of the liquid container.

16. The dip tube insertion member of claim 9, wherein:
(a) the probe includes a lower portion having an unsealing and retaining member for unsealing an inner cap of a two-piece sealing cap of the liquid container and retaining the unsealed inner cap of the two-piece sealing cap on the probe.

17. An apparatus for dispensing a liquid from a liquid storage container operably associated with the apparatus for dispensing a liquid, said apparatus comprising:
(a) a main housing having a dispensing location at which liquid from a liquid storage container is dispensed and a storage location for storing the liquid storage container, said dispensing location being disposed above at least a portion of said storage location and said main housing including a cup supporting surface for supporting a cup adjacent the dispensing location;
(b) a dip tube and at least one conduit, the at least one conduit connects the dip tube to the dispensing location;
(c) a dip tube insertion cap having at least one upper wall, at least one outer wall and a probe, the probe having a hollow cavity for receiving the dip tube, the probe further including an upper opening and a lower opening for facilitating insertion of the dip tube into the liquid storage container, the probe being configured to unseal a sealing member of a sealing cap of the liquid storage container to permit insertion of the dip tube into the liquid storage container without removing the sealing cap from the liquid storage container, the at least one outer wall of the dip tube insertion cap forms an inner receiving area for receiving at least a portion of the sealing cap of the liquid storage container such that when the dip tube insertion cap is installed on the liquid storage container having the sealing cap a section of the sealing cap of the liquid storage container extends into the receiving area and a portion of the dip tube insertion cap surrounds and covers at least a portion of the sealing cap of the liquid storage container.

18. The apparatus of claim 17, wherein:
(a) the dip tube insertion cap includes an annular sealing member forming an air chamber surrounding the probe.

19. The apparatus of claim 18, wherein:
(a) the probe includes at least one vertically extending groove formed in an outer surface of the probe, the at least one vertically extending groove communicates with the air chamber.

20. The apparatus of claim 19, further including:
(a) a liquid storage container having a sealing cap being disposed in the storage location, the dip tube insertion cap being mounted on and surrounding the sealing cap of the liquid storage container, the air chamber being formed between the at least one upper wall of the dip tube insertion cap and an uppermost surface of the sealing cap of the liquid storage container.

* * * * *